US009920592B2

(12) United States Patent
Watson

(10) Patent No.: US 9,920,592 B2
(45) Date of Patent: Mar. 20, 2018

(54) WELL TOOL WITH INDEXING DEVICE

(71) Applicant: THRU TUBING SOLUTIONS, INC., Oklahoma City, OK (US)

(72) Inventor: Brock W. Watson, Sadler, TX (US)

(73) Assignee: Thru Tubing Solutions, Inc., Oklahoma City, OK (US)

( * ) Notice: Subject to any disclaimer, the term of this patent is extended or adjusted under 35 U.S.C. 154(b) by 0 days.

(21) Appl. No.: 14/828,703

(22) Filed: Aug. 18, 2015

(65) Prior Publication Data

US 2016/0115767 A1 Apr. 28, 2016

(30) Foreign Application Priority Data

Oct. 28, 2014 (WO) ..... PCT/US2014/062651

(51) Int. Cl.
*E21B 34/14* (2006.01)
*E21B 23/00* (2006.01)

(52) U.S. Cl.
CPC ..... *E21B 34/14* (2013.01); *E21B 23/004* (2013.01)

(58) Field of Classification Search
CPC ..... E21B 10/00; E21B 33/12; E21B 34/14
USPC ..... 166/373
See application file for complete search history.

(56) References Cited

U.S. PATENT DOCUMENTS 2,034,768 A 3/1936 O'Neill
5,366,019 A 11/1994 Brooks
8,490,702 B2 7/2013 Stromquist et al.
2004/0050546 A1 3/2004 Tinker
2004/0168832 A1* 9/2004 Russell ..... E21B 23/006 175/321
2005/0045338 A1 3/2005 Howlett
2013/0269951 A1* 10/2013 Tahoun ..... E21B 34/06 166/373
2014/0262211 A1* 9/2014 Xu ..... E21B 23/006 166/179

OTHER PUBLICATIONS

Search Report and Written Opinion dated Jul. 15, 2015 for International Application PCT/US14/62651, 9 pages.

* cited by examiner

*Primary Examiner* — Amber R Anderson
*Assistant Examiner* — Patrick F Lambe
(74) *Attorney, Agent, or Firm* — Smith IP Services, P.C.

(57) ABSTRACT

A well tool can include an operator device with an operator profile and at least two routes, and an indexing device with a cam and a cam follower including a structure. The structure engages the routes in succession in response to relative displacement between the operator profile and cam. A method can include causing relative displacement between an operator device and an indexing device in one direction, thereby causing a structure to disengage from one route of the operator device and displace an initial distance between two routes in response to engagement between the cam follower and a cam, and causing relative displacement between the operator and indexing devices in an opposite direction, thereby causing the structure to displace a remaining distance between the routes in response to engagement between the cam follower and an operator profile of the operator device, and to displace along the second route.

29 Claims, 18 Drawing Sheets

WELL TOOL WITH INDEXING DEVICE

CROSS-REFERENCE TO RELATED APPLICATION

The present application claims the benefit under 35 USC § 119 of the filing date of International Application No. PCT/US14/62651, filed 28 Oct. 2014. The entire disclosure of this prior application is incorporated herein by this reference.

BACKGROUND

This disclosure relates generally to equipment utilized and operations performed in conjunction with subterranean wells and, in one example described below, more particularly provides a well tool with an indexing device.

It is sometimes desirable to change configurations of well tools downhole. For example, a valve may be changed from open to closed (and/or closed to open), a packer assembly may be changed from unset to set (and/or set to unset), a reamer may be changed from retracted to extended (and/or from extended to retracted), etc.

Therefore, it will be readily appreciated that improvements are continually needed in the art of operating well tools downhole. Such improvements could be used with any type of well tool, for changing a configuration of the well tool, for changing a mode of operation of the well tool, or for any other operational purpose.

DETAILED DESCRIPTION

Figure 1:
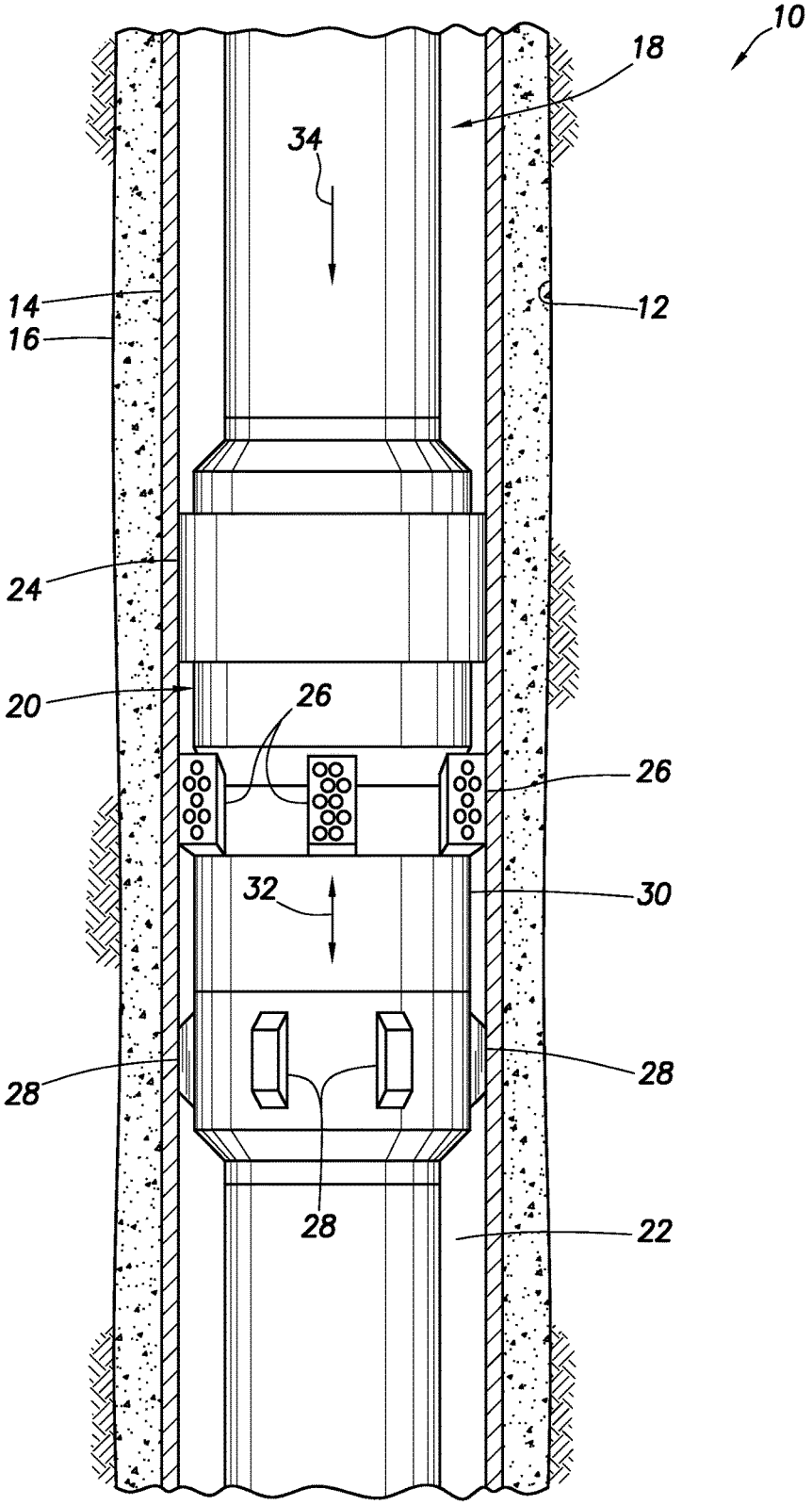
FIG. 1 is a representative partially cross-sectional view of an example of a well system and associated method which can embody principles of this disclosure.

Representatively illustrated in FIG. 1 is a system 10 for use with a well, and an associated method, which system and method can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a generally vertical wellbore 12 is lined with casing 14 and cement 16. A generally tubular string 18 (such as, a segmented or continuous string) is positioned in the wellbore 12. The tubular string 18 may be used for drilling, testing, stimulation, conformance, completion, production, remediation or any other purpose.

Note that it is not necessary for the wellbore 12 to be vertical, or for the wellbore to be cased or cemented. The principles of this disclosure are applicable to horizontal or inclined wellbores, and to uncased or open hole wellbores. In addition, it is not necessary for a tubular string to be positioned in a wellbore, or for a well tool incorporating the principles of this disclosure to be incorporated in a tubular string.

In the FIG. 1 example, a well tool 20 of the type known to those skilled in the art as a packer or packer assembly is connected in the tubular string 18. The packer assembly in this example is used to seal off an annulus 22 formed radially between the tubular string 18 and the casing 14 (or wellbore 12 if the wellbore is uncased), and to secure the tubular string in the wellbore.

For these purposes, the packer assembly includes a radially extendable seal element 24 and slips 26. When the packer assembly is set, slips 26 grip an inner surface of the casing 14 (or wellbore 12) and the seal element 24 extends radially outward into sealing engagement with the casing (or wellbore).

In this example, a single seal element 24 and multiple slips 26 are used in the packer assembly. However, in other examples, multiple seal elements and/or a single slip (such as, a barrel slip) may be used. In further examples, the well tool 20 may not include any seal element and/or any slip, or may not comprise a packer assembly. Thus, the scope of this disclosure is not limited to any specific details of the packer assembly or any other well tools described herein or depicted in the drawings.

To set the packer assembly of FIG. 1, the tubular string 18 is sequentially raised and lowered in a manner described more fully below, in order to operate an indexing device 30 of the packer assembly. A set of drag blocks 28 are biased against the casing 14 (or wellbore 12), so that a compressive force 32 can be created in the packer assembly in response to displacement of the tubular string 18 in a downward direction 34 (also known as slacking off on the tubular string or applying a weight of the tubular string to the packer assembly).

In this specification, the terms "upward" and "downward" are used for convenience in referring to the drawings (upward being toward a top of the drawings). Generally, upward can be in a direction toward a proximal end of a wellbore, and downward can be in a direction toward a distal end of a wellbore. However, the scope of this disclosure is not limited to any particular directions, whether upward, downward, above, below or any other described direction.

When the tubular string 18 is appropriately manipulated and displaced in the downward direction 34 to apply the compressive force 32 to the packer assembly, the slips 26 extend outward and grip the casing 14 or wellbore 12, thereby allowing the compressive force to be applied to the seal element 24 above the slips. The seal element 24 extends radially outward and seals against the casing 14 or wellbore 12.

In the FIG. 1 example, the indexing device 30 controls how or whether the compressive force 32 is applied to actuate the slips 26 in response to the manipulation of the tubular string 18. Not every downward displacement of the tubular string 18 results in actuation of the slips 26. Instead, in this example, the tubular string 18 must be raised (displaced opposite to the direction 34), and then lowered, in order to cause actuation of the slips 26.

In addition, only every other sequence of raising and then lowering the tubular string 18 will cause actuation of the slips 26. The packer assembly can be unset by raising the tubular string 18. Lowering of the tubular string 18 in sequences that do not cause actuation of the slips 26 can permit the packer assembly to be repositioned in the well.

Figure 2:
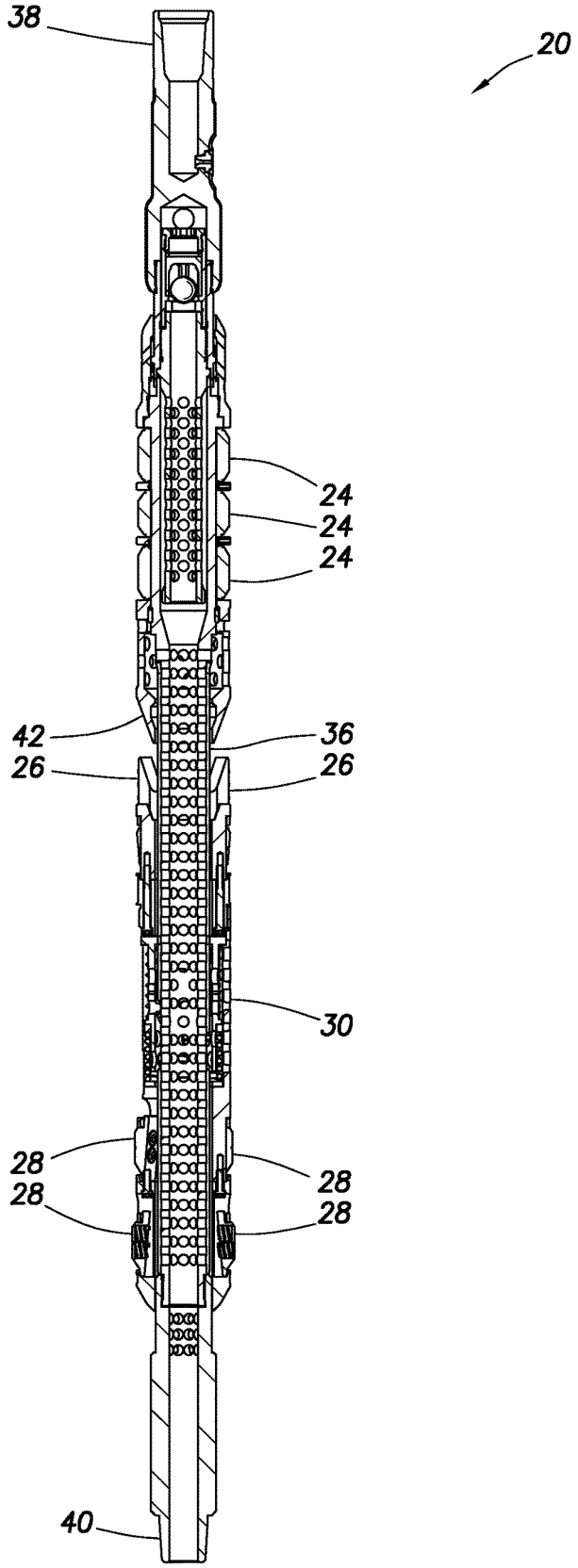
FIG. 2 is an enlarged scale representative cross-sectional view of an example of a packer assembly that can embody the principles of this disclosure, and that can be used in the system and method of FIG. 1.

Referring additionally now to FIG. 2, an enlarged scale cross-sectional view of an example of the well tool 20 is representatively illustrated, apart from the remainder of the well system 10. Of course, the well tool 20 may be used in a wide variety of other well systems and methods, in keeping with the principles of this disclosure.

In the FIG. 2 example, the packer assembly can be connected in the tubular string 18 via upper and lower threaded connectors 38, 40 attached to an operator device 36. As depicted in FIG. 2, the operator device 36 is in the form of a generally tubular inner mandrel of the packer assembly. However, the scope of this disclosure is not limited to use of any particular type or form of operator device.

The indexing device 30 is positioned between the slips 26 and the drag blocks 28. The drag blocks 28 provide resistance to displacement of the indexing device 30 and slips 26 relative to the casing 14 or wellbore 12. In this manner, relative displacement between the operator device 36 and the indexing device 30 can be produced by raising or lowering the tubular string 18.

In other examples, the drag blocks 28 may not be used, the indexing device 30 may not be positioned between the drag blocks and the slips 26, drag blocks may not be used to produce relative displacement between the indexing device and the operator device 36, etc. Thus, the scope of this disclosure is not limited to any particular details of the packer assembly depicted in FIG. 2, and is not limited to use of a packer assembly at all.

When the indexing device 30 permits the operator device 36 to displace downward a sufficient distance relative to the indexing device, the slips 26 will engage a conical wedge 42, thereby causing the slips 26 to deflect outward into gripping engagement with the casing 14 or wellbore 12. Further downward displacement of the operator device 36 (with the tubular string 18 above the connector 38) will cause the seal elements 24 to be longitudinally compressed, thereby causing the seal elements to extend radially outward into sealing engagement with the casing 14 or wellbore 12.

Raising of the operator device 36 produces an opposite sequence of events. That is, raising of the operator device 36 relieves the longitudinal compression of the seal elements 24, thereby allowing them to radially retract out of sealing engagement with the casing 14 or wellbore 12. Further raising of the operator device 36 disengages the wedge 42 from the slips 26, thereby allowing them to retract out of gripping engagement with the casing 14 or wellbore 12.

By controlling an extent to which downward displacement of the operator device 36 relative to the indexing device 30 is produced by downward displacement of the tubular string 18, the indexing device can control whether the packer assembly is set in response to the downward displacement. The packer assembly is not set if the operator device 36 does not displace downward a sufficient distance relative to the indexing device 30 to allow the slips 26 to engage the wedge 42. The packer assembly will be set if the operator device 36 does displace downward a sufficient distance relative to the indexing device 30 to allow the slips 26 to engage the wedge 42.

Figure 3:
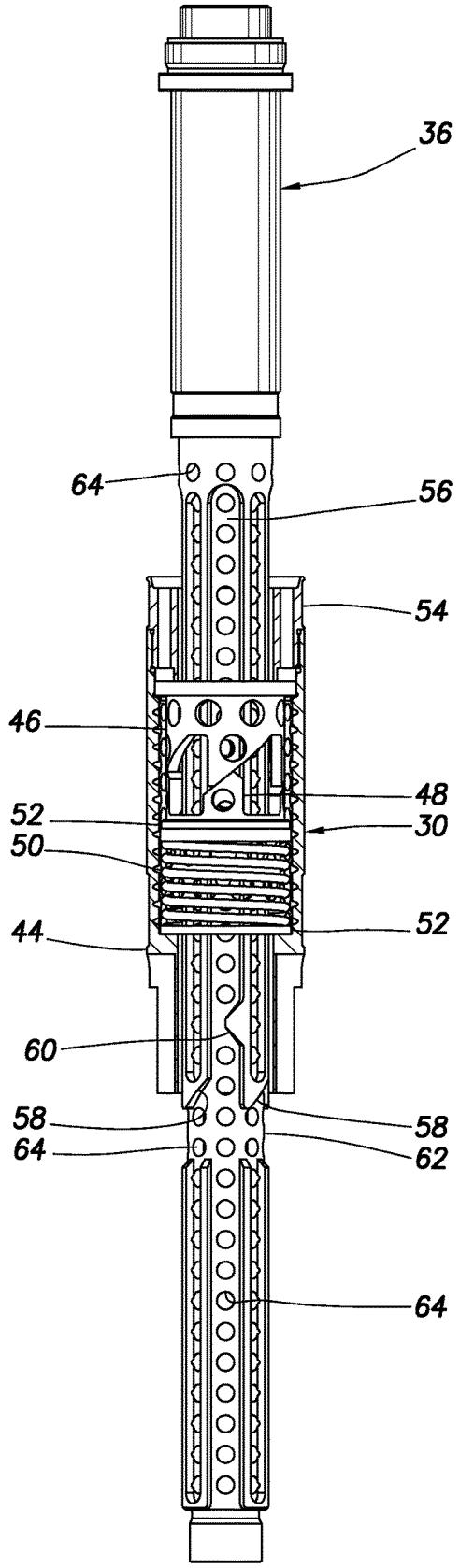
FIG. 3 is a further enlarged scale representative partially cross-sectional view of an example of an operator device and indexing device that can embody the principles of this disclosure, and that can be used in the packer assembly of FIG. 2.

Referring additionally now to FIG. 3, the indexing device 30 and operator device 36 are representatively illustrated apart from the remainder of the well tool 20. Of course, the indexing device 30 and operator device 36 may be used with other well tools, in keeping with the principles of this disclosure.

In the FIG. 3 example, the indexing device 30 includes an outer housing 44, a cam 46, a cam follower 48, a biasing device 50, bearings 52 and a retainer 54. The retainer 54 retains the cam 46, cam follower 48, biasing device 50 and bearings 52 in the housing 44.

The biasing device 50 is used to bias the cam 46 and cam follower 48 toward engagement with each other, while enabling the cam follower to displace longitudinally in the housing 44. The biasing device 50 is depicted in FIG. 3 as a coil spring, but other types of biasing devices (such as, other types of springs, a compressed gas chamber, a compressible liquid or solid material, etc.) may be used in other examples. The scope of this disclosure is not limited to use of any particular type of biasing device.

The bearings 52 enable the cam follower 48 to more readily rotate within the housing 44, in response to engagement of the cam follower with the cam 46 and a profile 58 formed on the operator device 36, as described more fully below. Note that the cam 46 does not rotate relative to the operator device 36, but the operator device can displace longitudinally relative to the cam.

The operator device 36 has multiple circumferentially distributed routes 56 formed thereon. In the FIG. 3 example, the routes 56 are in the form of grooves or recesses extending longitudinally in an outer surface of the operator device 36. Structures (not visible in FIG. 3) in the cam follower 48 engage the grooves or recesses, as described more fully below.

However, in other examples, the routes 56 could be in the form of protrusions, tracks or other types of structures engageable by the cam follower 48. In addition, although the operator device 36 is depicted in FIG. 3 as extending longitudinally through the indexing device 30, in other examples the indexing device could be internal to the operator device (e.g., with the routes 56 being formed in an internal surface of the operator device, and the cam 46, cam follower 48, biasing device 50, etc., of the indexing device being external to the housing 44). Thus, the scope of this disclosure is not limited in any way to the details of the indexing device 30 and operator device 36 described herein or depicted in the drawings.

Note that one of the routes 56 has an obstruction 60 therein, which causes the route to be narrowed at the obstruction. Another one of the routes 56 on an opposite side of the operator device 36 has a similar obstruction 60. These obstructions 60 cause their corresponding routes 56 to be effectively shorter with respect to certain structures (not visible in FIG. 3) in the cam follower 48, as described more fully below.

In addition, note that an external area 62 of the operator device 36 is free of the routes 56. This area 62 of the operator member 36 allows the cam follower 48 to rotate relative to the operator member in response to engagement between the cam follower and the cam 46 or the operator profile 58 when the cam follower is positioned at the area.

Many components of the indexing device 30 and operator device 36 are perforated in the illustrated examples. Perforations 64 allow debris, sand, formation fines, proppant, etc., to pass through the components, in order to prevent fouling, sticking or other malfunctions. Placement of the perforations 64 in components that experience relative displacement between them aids in flushing debris, etc., out of the well tool 20 when such relative displacement occurs.

However, the perforations 64 are not necessary in keeping with the principles of this disclosure. In some of the drawings, some or all of the perforations 64 are removed for clarity of illustration.

Figure 4:
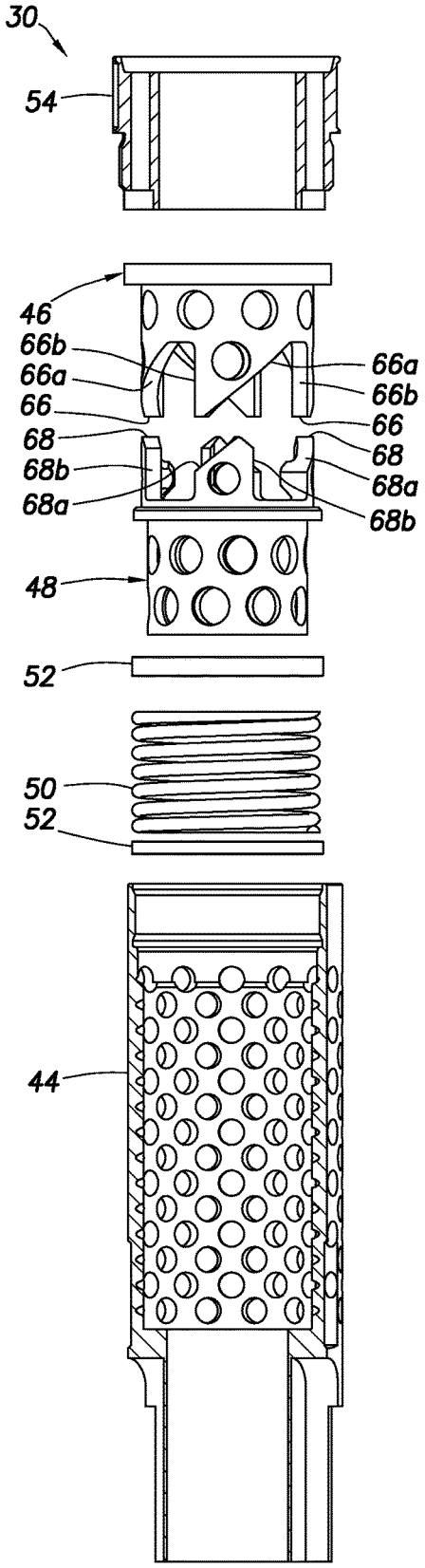
FIG. 4 is a further enlarged scale representative exploded view of the indexing device.

Referring additionally now to FIG. 4, a further enlarged scale longitudinally exploded view of the indexing device 30 is representatively illustrated. In this view, a manner in which the components of the indexing device 30 cooperate with each other can be more readily seen.

The cam 46 includes a series of four circumferentially distributed profiles 66 formed on a lower end thereof. Each of the profiles 66 includes a helically extending surface 66*a* and a longitudinally extending surface 66*b*. However, the cam 46 can include other numbers, types and configurations of profiles in keeping with the principles of this disclosure.

Similarly, the cam follower 48 includes a series of four circumferentially distributed profiles 68 formed on an upper end thereof. Each of the profiles 68 includes a helically extending surface 68*a* and a longitudinally extending surface 66*b*. However, the cam follower 48 can include other numbers, types and configurations of profiles in keeping with the principles of this disclosure, and it is not necessary for the cam 46 and the cam follower to include the same number, type or configuration of profiles.

It will be appreciated that, if the cam follower 48 as depicted in FIG. 4 is longitudinally biased by the biasing device 50 into engagement with the cam 46 as depicted in FIG. 4, the profiles 66, 68 (more specifically, the inclined surfaces 66*a*, 68*a*) will cause relative rotation between the cam and the cam follower, until the surfaces 66*b*, 68*b* engage each other. If the cam 46 is prevented from rotating relative to the operator device 36 (as described more fully below), the cam follower 48 will be thereby rotated relative to the operator device.

Figure 5:
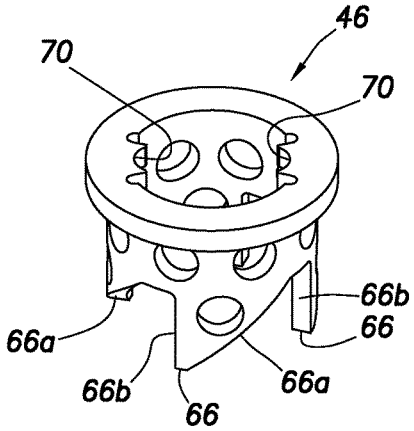
FIG. 5 is a representative perspective view of a cam of the indexing device.

Referring additionally now to FIG. 5, a perspective view of the cam 46 is representatively illustrated apart from the remainder of the indexing device 30. In this view, it may be seen that longitudinally extending structures 70 are formed in the cam 46. Two of the structures 70 are depicted in the FIG. 5 example, but any number of structures may be used in keeping with the principles of this disclosure.

The structures 70 engage and displace longitudinally along certain ones of the routes 56 on the operator device 36 (see FIG. 3). In this example, the structures 70 do not engage the routes 56 having the obstructions 60 therein. Thus, the obstructions 60 do not limit relative displacement between the operator device 36 and the cam 46.

The structures 70 prevent relative rotation between the operator device 36 and the cam 46. The structures 70 are depicted in the FIG. 5 example as being in the form of keys, lugs or other protrusions configured for engagement with the routes 56, which are in the form of longitudinally extending grooves or recesses. However, the structures 70 could instead be in the form of grooves, recesses, etc., for example, if the routes 56 are in the form of protrusions, etc. Thus, the scope of this disclosure is not limited to use of any particular forms of the routes 56 or structures 70.

Figure 6:
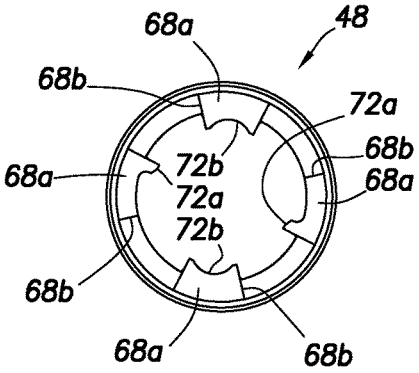
FIG. 6 is a representative top view of a cam follower of the indexing device.

Referring additionally now to FIG. 6, a top view of the cam follower 48 is representatively illustrated apart from the remainder of the indexing device 30. In this view, it may be seen that the cam follower 48 has structures 72*a,b* formed therein, somewhat similar to the structures 70 in the cam 46.

However, the cam follower 48 in this example includes two each of the structures 72*a,b*, and the structures are not identical to each other. The structures 72*b* in the cam follower 48 are similar in form to the structures 70 in the cam 46, but the structures 72*a* have a reduced width as compared to the other structures 70, 72*b*.

The reduced widths of the structures 72*a* allow the structures to pass through the narrowed portions of the routes 56 in the operator device 36 having the obstructions 60 therein (see FIG. 3). The structures 72*b*, however, cannot displace through the routes 56 past the obstructions 60. Thus, when the structures 72*b* are engaged with the routes 56 having the obstructions 60 therein, relative displacement between the indexing device 30 and the operator device 36 is much more limited as compared to when the structures 72*a* are engaged with the routes having the obstructions therein.

Referring additionally now to FIGS. 7A-12B, various configurations of the indexing device 30 and operator device 36 are representatively illustrated. These provide a more complete understanding of how an amount of relative displacement between the indexing and operator devices 30, 36 can be effectively controlled using the principles of this disclosure. However, it should be clearly understood that the scope of this disclosure is not limited to any of the details of the configurations or operation of the indexing and operator devices 30, 36 shown in the drawings or described herein, since many variations are possible (for example, variations in numbers, types, forms and arrangements of components, variations in numbers, types, shapes and configurations of engaging profiles and surfaces, integration or separate forming of components, etc.).

Figure 7A:
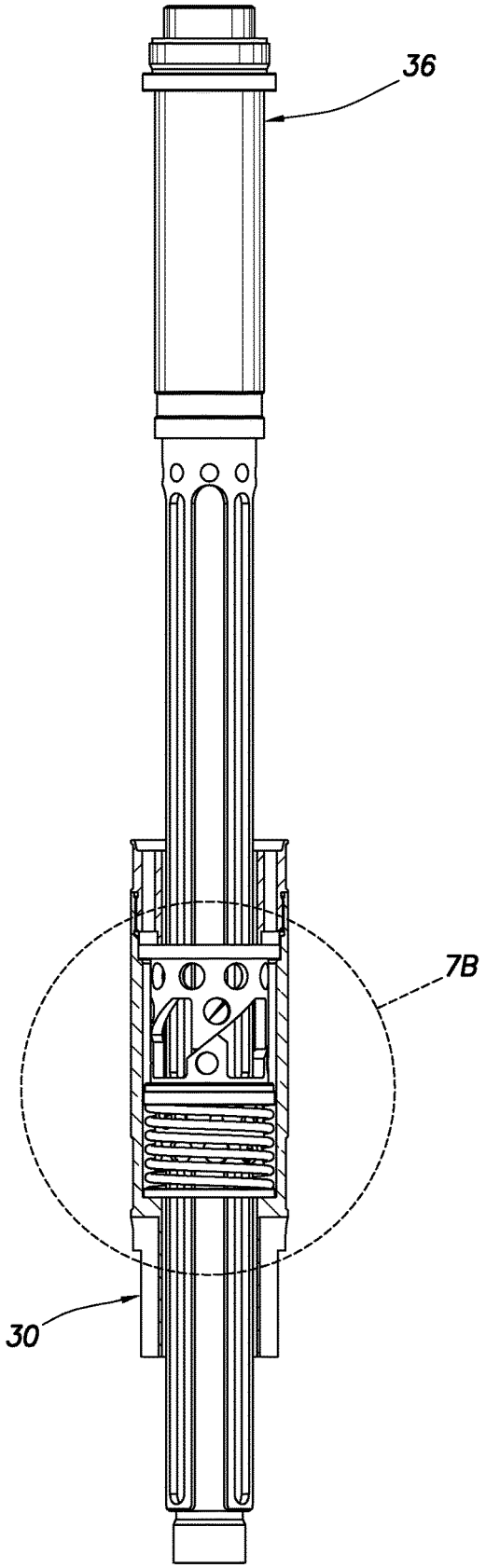
FIGS. 7A-12B are representative partially cross-sectional views of the operator and indexing devices in various stages of operation.
Figure 7B:
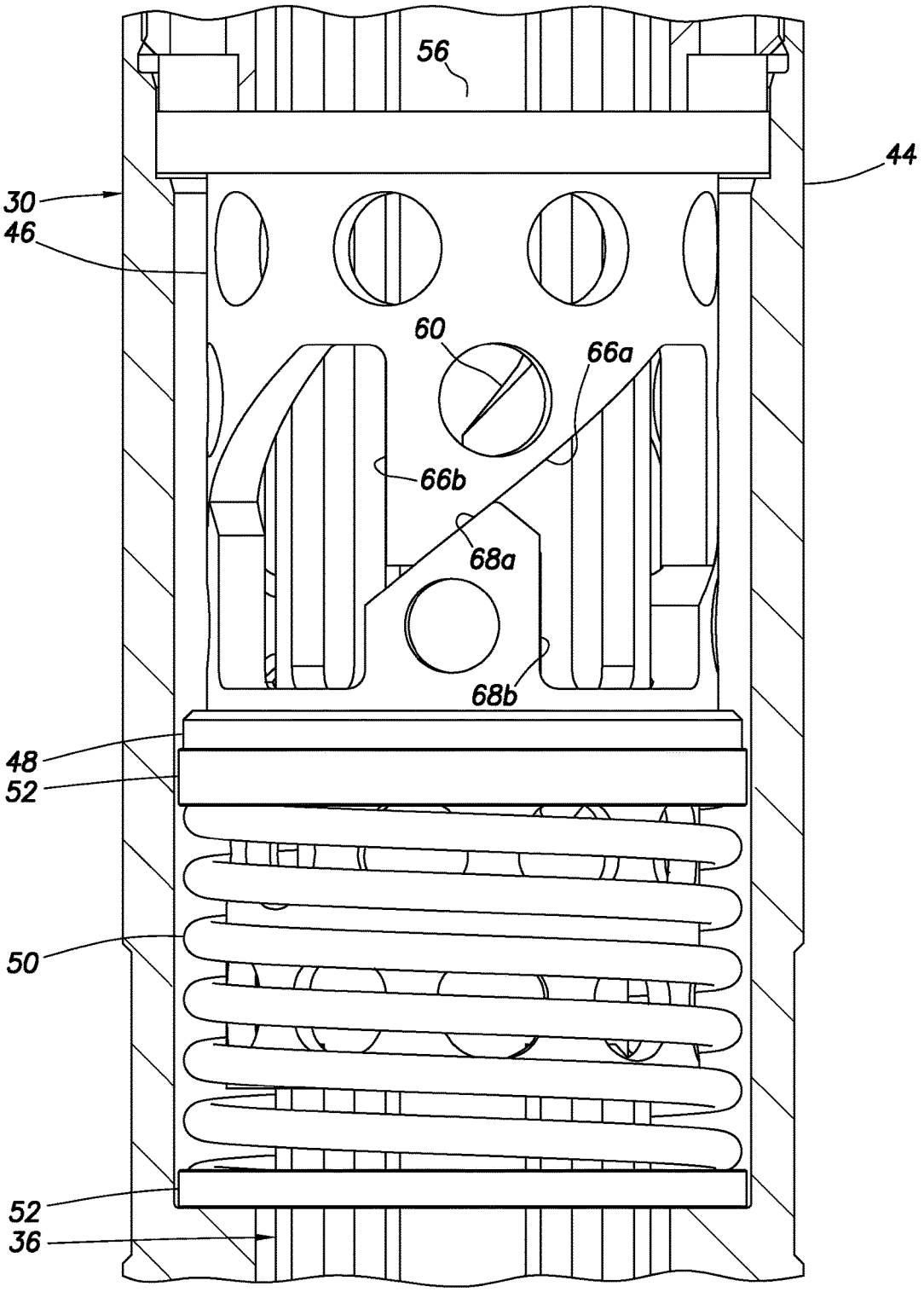

In FIGS. 7A & B, the indexing and operator devices 30, 36 are depicted in a configuration in which the structure 72*b* (not visible, see FIG. 6) of the cam follower 48 is engaged with the route 56 having the obstruction 60 therein. Thus, downward displacement of the operator device 36 relative to the indexing device 30 is limited.

Some downward displacement of the operator device 36 relative to the indexing device 30 is permitted in the FIGS. 7A & B configuration (for example, limited by complete compression of the biasing device 50). However, this limited displacement is not sufficient to allow the slips 26 to engage the wedge 42 when the indexing and operator devices 30, 36 are used in the packer assembly of FIG. 2, and so setting of the packer assembly is prevented. This may be considered a "run in" or initial configuration of the indexing and operator devices 30, 36 when used in the packer assembly.

Figure 8A:
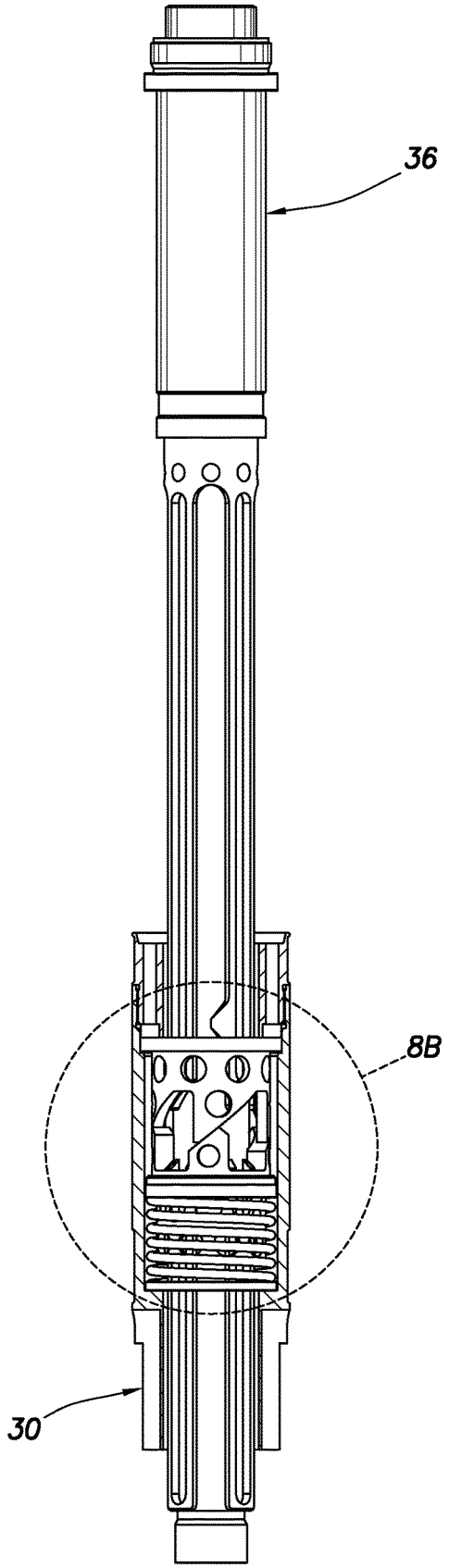
Figure 8B:
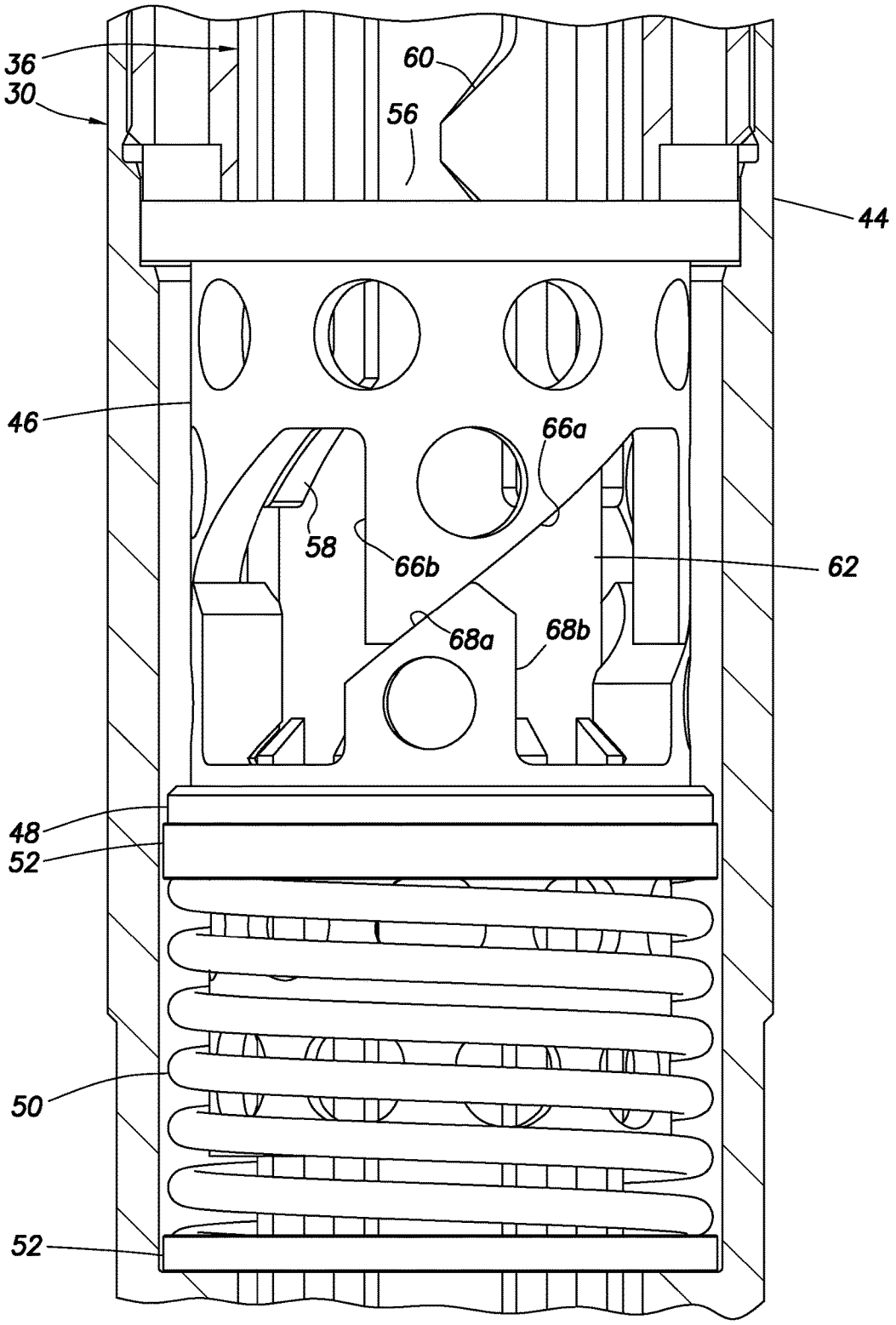

In FIGS. 8A & B, the operator device 36 has been raised somewhat relative to the indexing device 30. In this configuration, the cam follower 48 is no longer engaged with any of the routes 56 (that is, the structures 72*a,b* in the cam follower are not engaged with the routes, but are instead at the area 62 on the operator device 36).

Thus, the cam follower 48 can now rotate relative to the operator device 36 and cam 46, due to engagement between the surfaces 66*a*, 68*a* and a biasing force exerted by the biasing device 50. The cam follower 48 will continue to rotate until the surfaces 66*b*, 68*b* engage each other. This rotation of the cam follower 48 results in the structures 72*a,b* displacing partially (an initial distance) rotationally from one route 56 to the next.

Figure 9A:
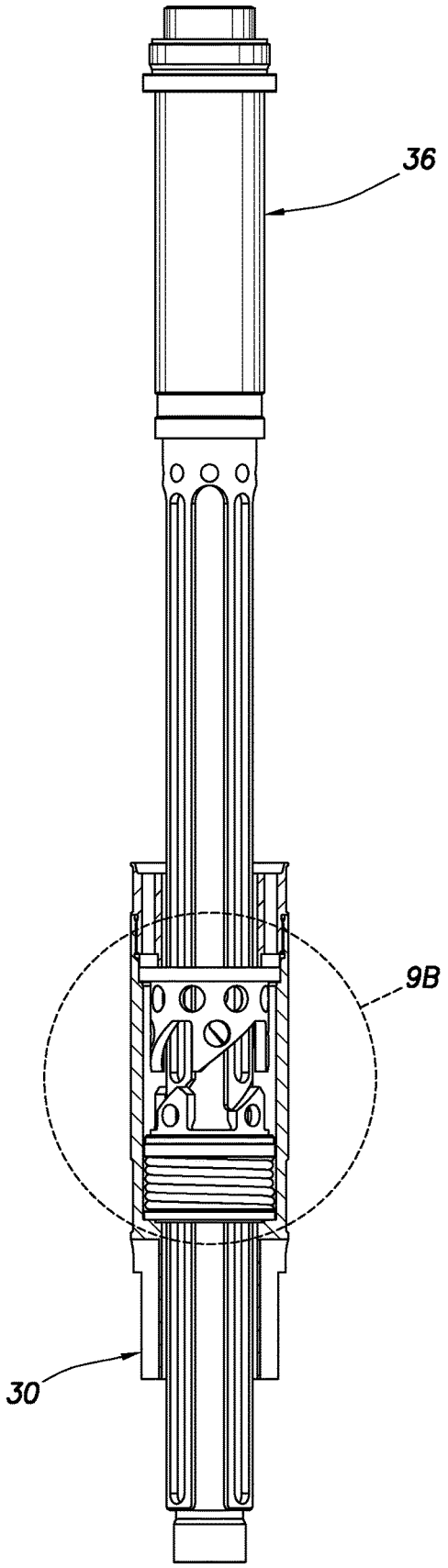
Figure 9B:
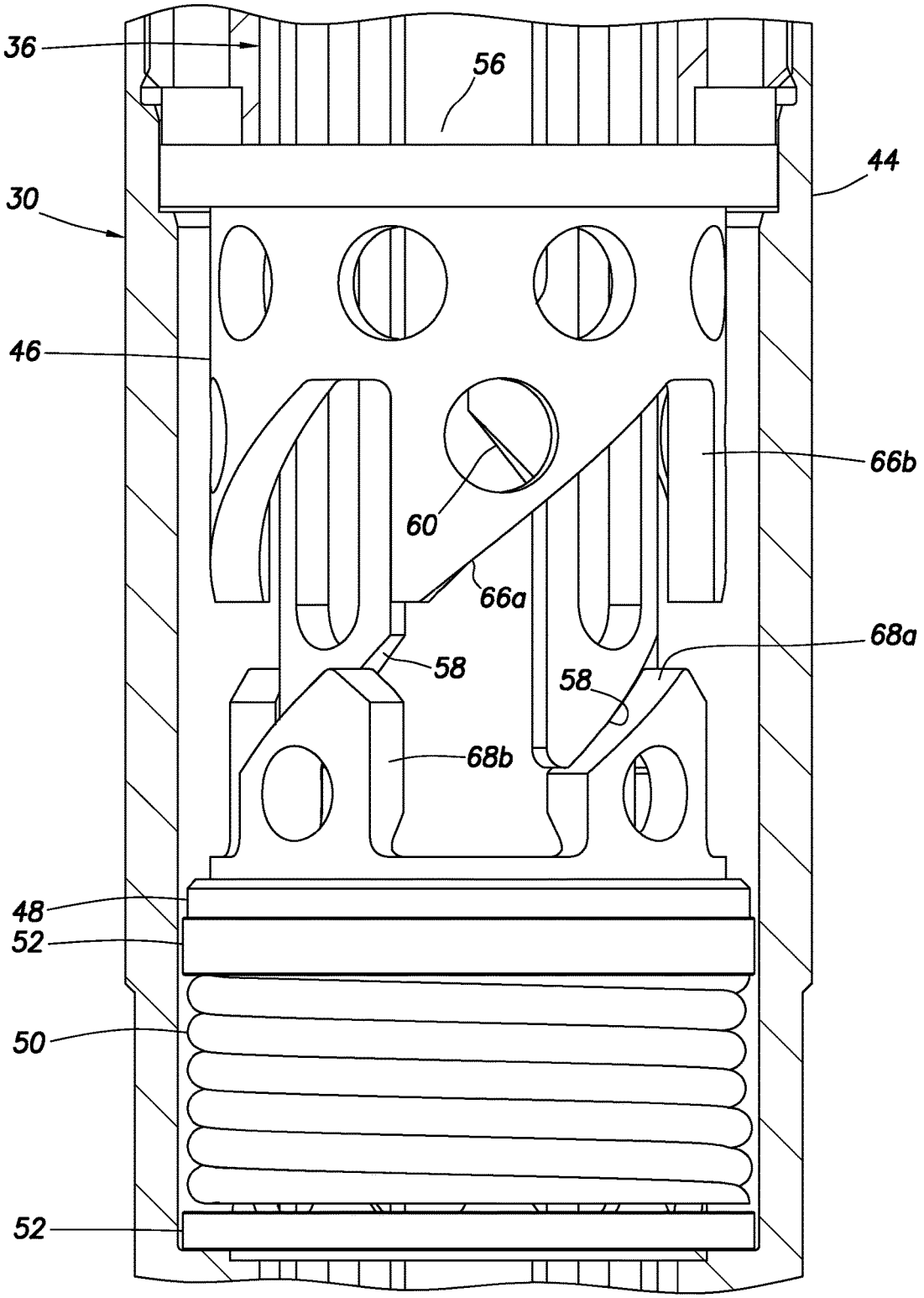

In FIGS. 9A & B, the operator device 36 has been displaced downward relative to the indexing device 30 after the engagement between the surfaces 66*b*, 68*b* has stopped relative rotation between the cam follower 48 and the operator device 36. Note that the cam follower 48 displaces downward with the operator device 36, due to engagement between the profiles 58 and surfaces 68*a*.

When the cam follower 48 is displaced downward sufficiently, so that the surfaces 66*b*, 68*b* no longer limit rotation of the cam follower, the cam follower can again rotate relative to the operator device 36 due to the engagement between the profiles 58 and surfaces 68*a* and the biasing force exerted by the biasing device 50. The cam follower 48 will continue to rotate until the surfaces 68*b* engage the routes 56. Thus, this rotation of the cam follower 48 results in the structures 72*a,b* displacing a remaining distance rotationally from one route 56 to the next.

Figure 10A:
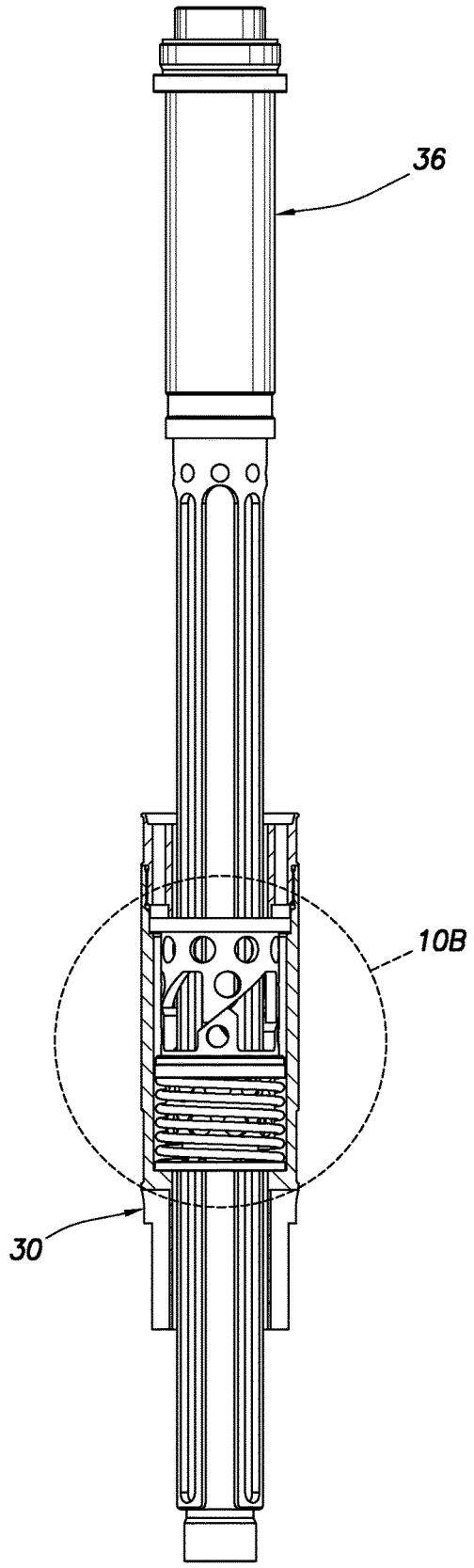
Figure 10B:
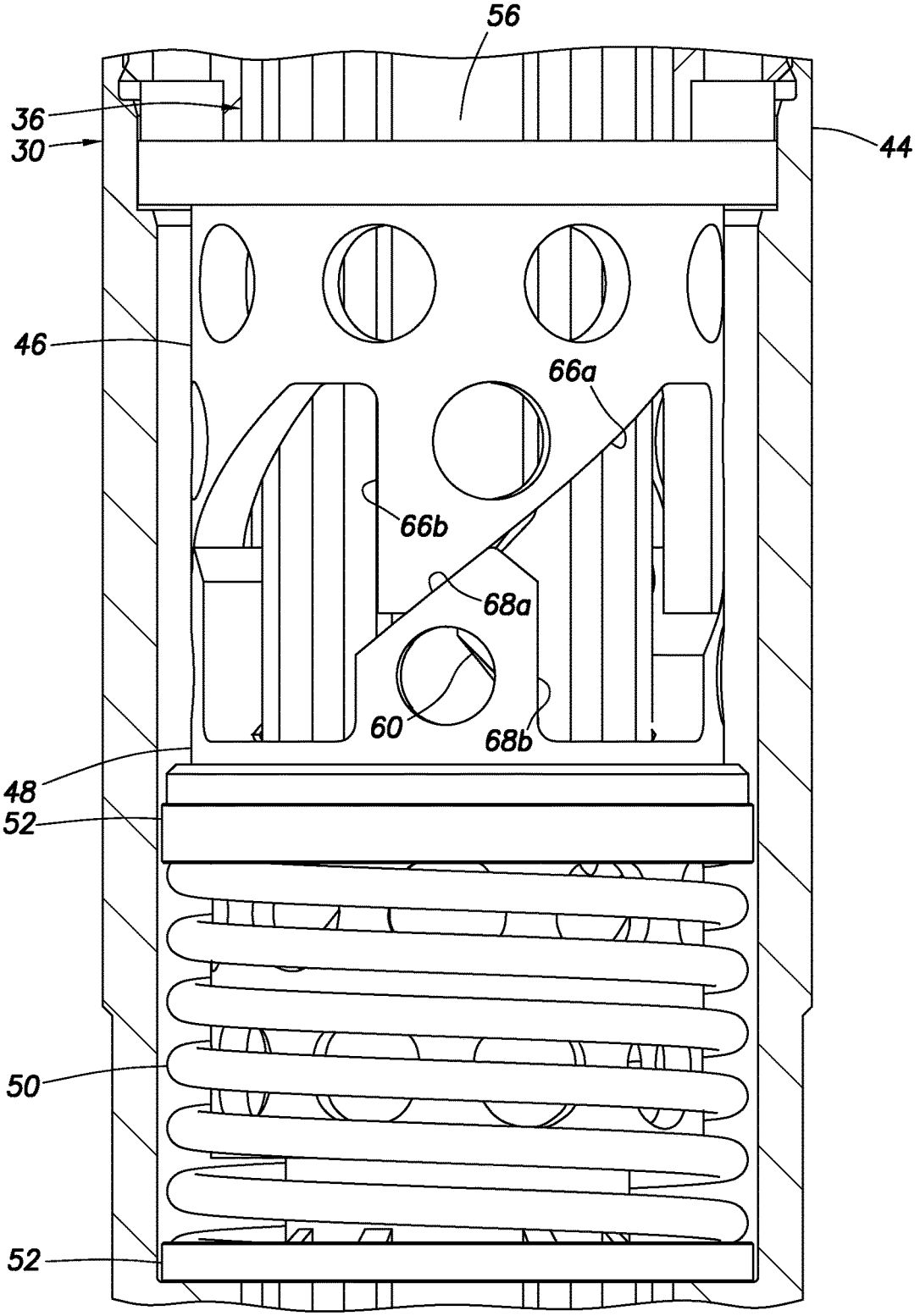

In FIGS. 10A & B, the cam follower 48 has rotated to a position in which the structures 72*a* (see FIG. 6) are engaged with the routes 56 having the obstructions 60 therein, and the operator device 36 has been displaced downward somewhat relative to the indexing device 30. Since the obstructions 60 are permitted to displace downward past the structures 72*a* in the cam follower 48, the obstructions (and the structures 72*b*) do not limit the downward displacement of the operator device 36.

Figure 11A:
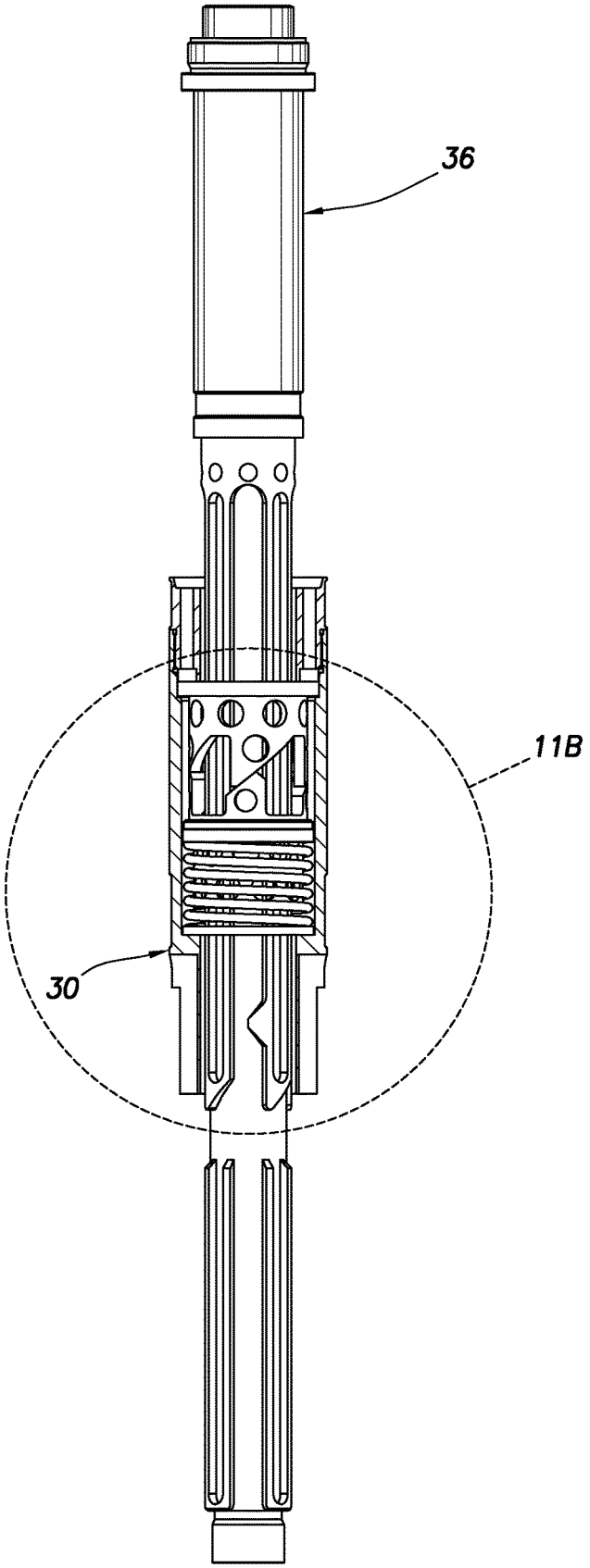
Figure 11B:
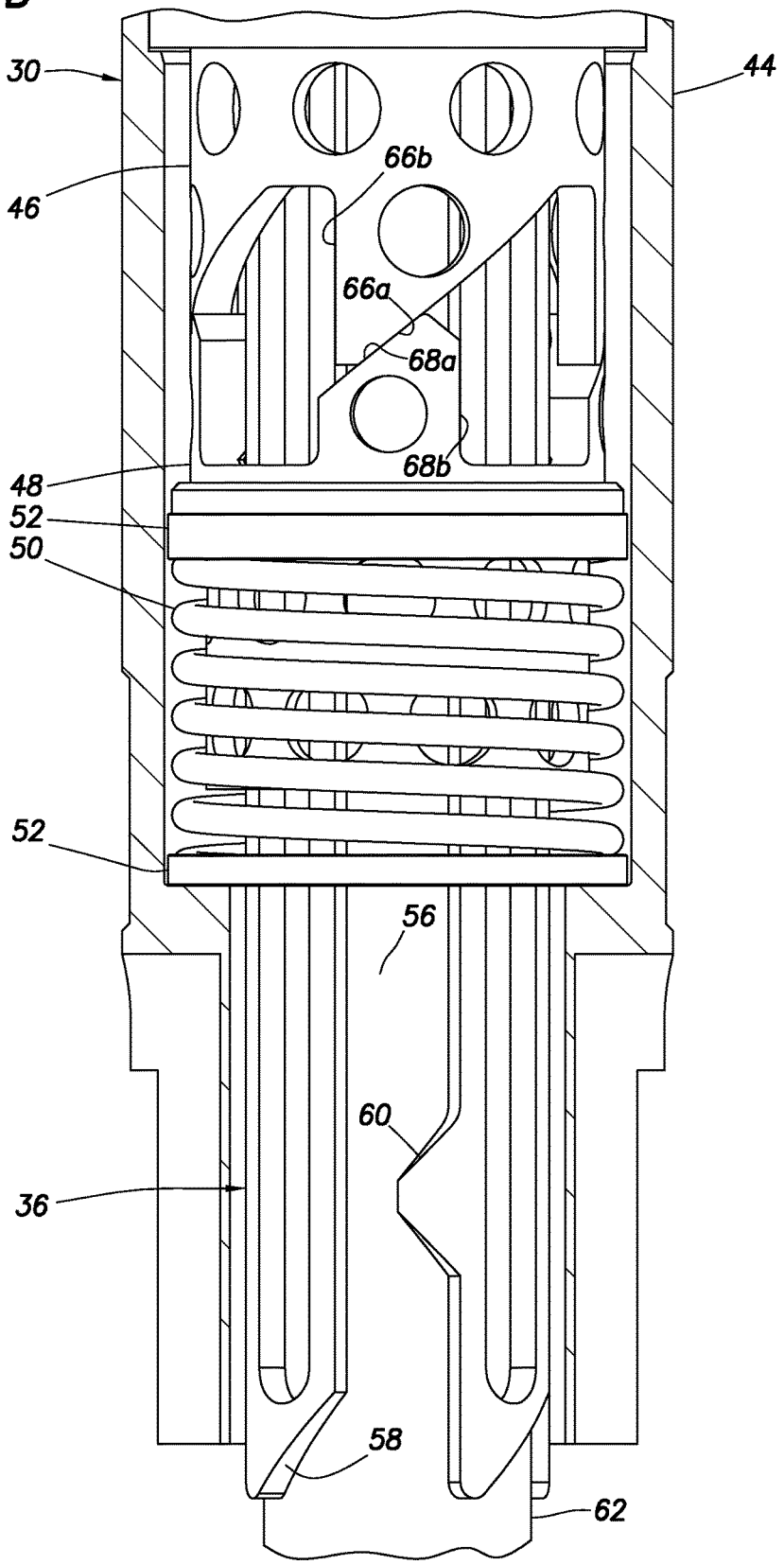

In FIGS. 11A & B, the operator device 36 has been displaced further downward relative to the indexing device 30. When used in the packer assembly of FIG. 2, such further downward displacement is sufficient to cause the slips 26 to engage the wedge 42 and the packer assembly can be set.

If the operator device 36 is again raised relative to the indexing device 30 (for example, to cause unsetting of the FIG. 2 packer assembly), the structures 72*a,b* in the cam follower 48 will again disengage from the routes 56, and the cam follower will rotate relative to the operator device 36 and cam 46, due to engagement between the surfaces 66*a*, 68*a* and the biasing force exerted by the biasing device 50. The cam follower 48 will continue to rotate until the surfaces 66*b*, 68*b* engage each other. This rotation of the cam follower 48 will result in the structures 72*a,b* displacing a portion of the distance rotationally from one route 56 to the next.

Figure 12A:
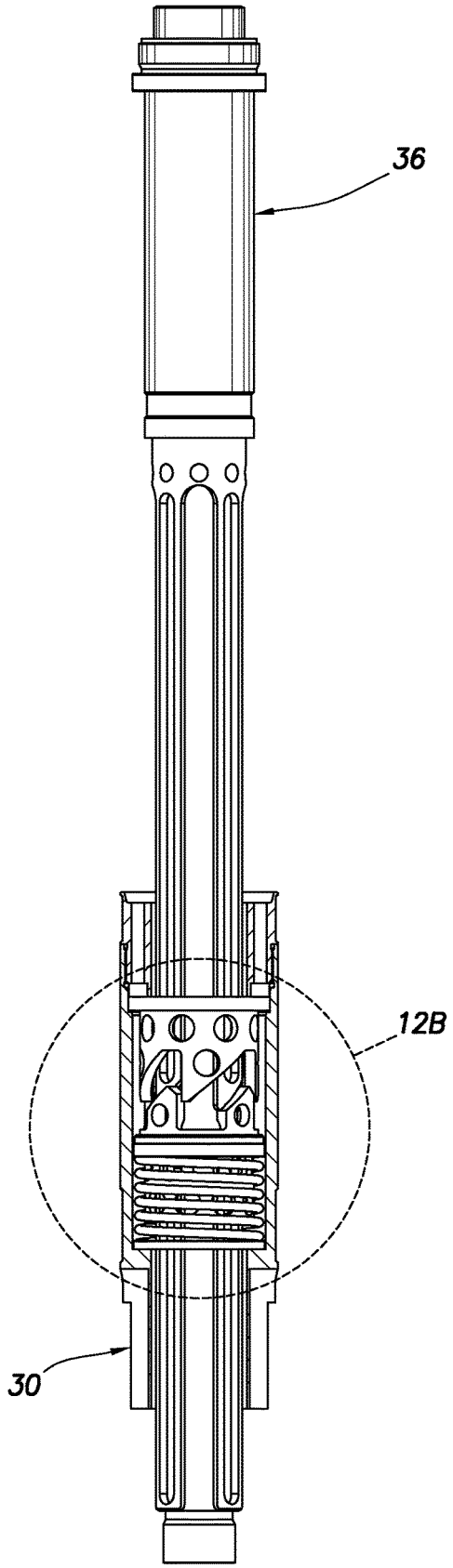
Figure 12B:
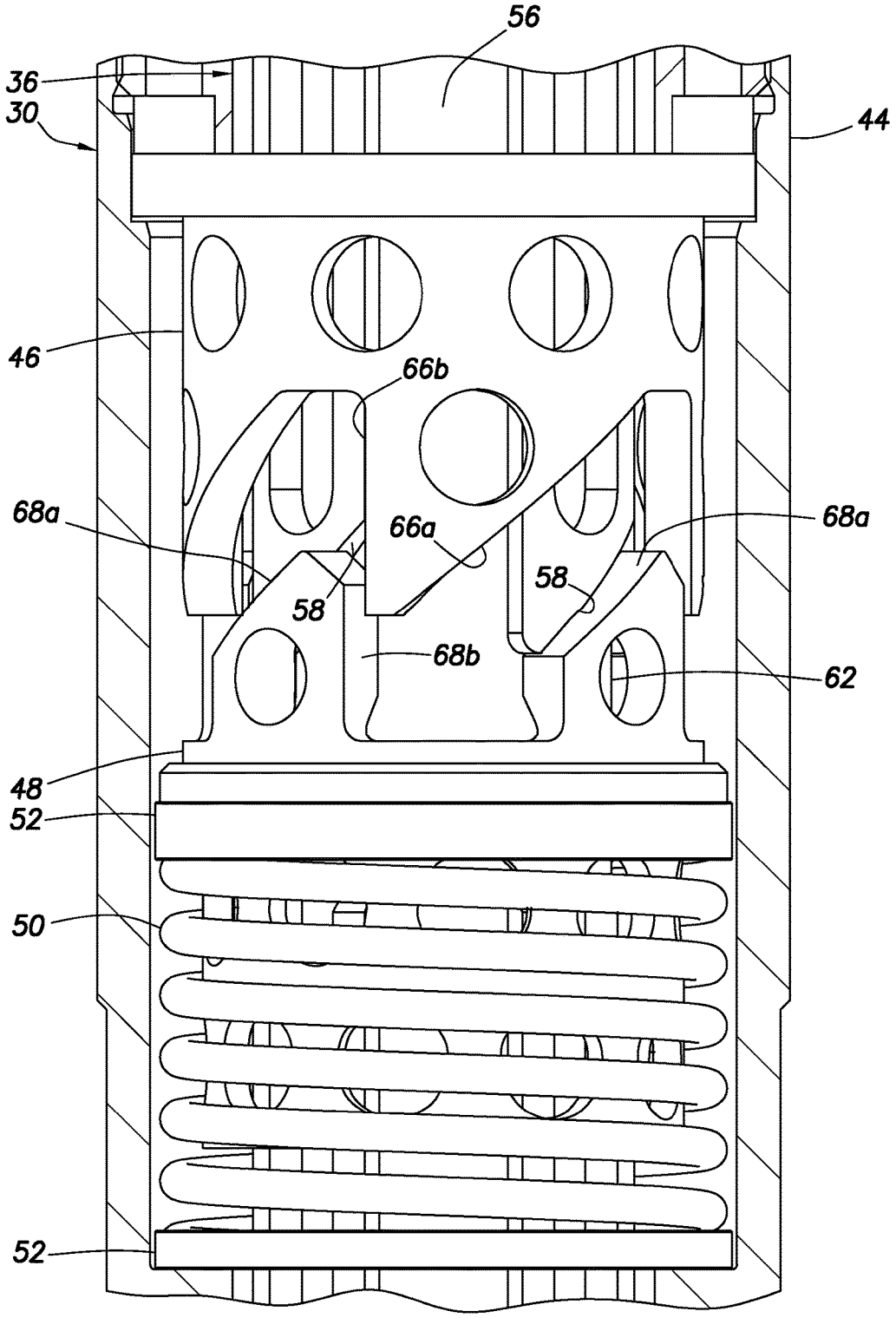

In FIGS. 12A & B, the operator device 36 has been displaced downward relative to the indexing device 30 after the engagement between the surfaces 66*b*, 68*b* has stopped relative rotation between the cam follower 48 and the operator device 36. Note that the cam follower 48 displaces downward with the operator device 36, due to engagement between the profiles 58 and surfaces 68*a*.

When the cam follower 48 is displaced downward sufficiently, so that the surfaces 66*b*, 68*b* no longer limit rotation of the cam follower, the cam follower can again rotate relative to the operator device 36 due to the engagement between the profiles 58 and surfaces 68*a* and the biasing force exerted by the biasing device 50. The cam follower 48 will continue to rotate until the surfaces 68*b* engage the routes 56. Thus, this rotation of the cam follower 48 results in the structures 72*a,b* displacing a remaining distance rotationally from one route 56 to the next.

The indexing and operator devices 30, 36 can thereby be returned to the configuration of FIGS. 7A & B (wherein the structures 72*b* are engaged in the routes 56 having the obstructions 60 therein to limit downward displacement of the operator device relative to the indexing device). The operation of the indexing and operator devices 30, 36 as described above can be repeated as many times as is required or desired. When used in the packer assembly of FIG. 2, this means that the packer assembly can be run in and set, unset and repositioned multiple times in the casing 14 or wellbore 12.

Figure 13A:
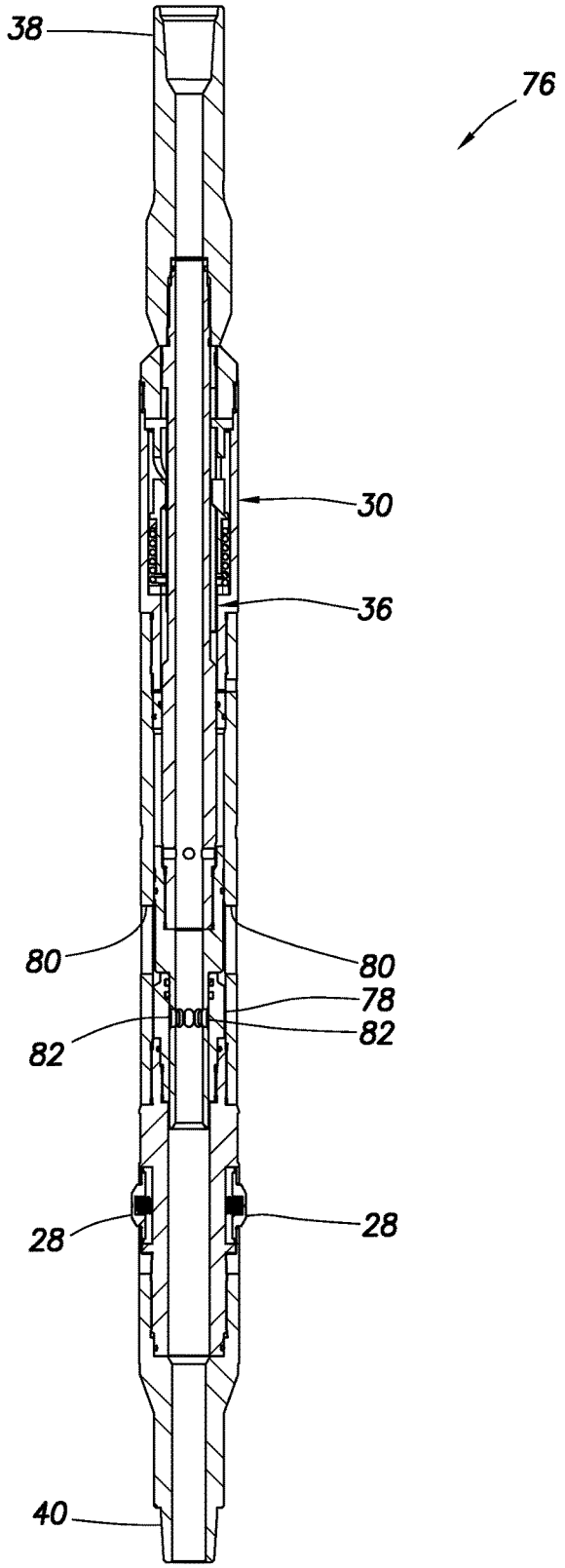
FIGS. 13A & B are representative partially cross-sectional views of an example of a valve that can embody the principles of this disclosure, in respective closed and open configurations.

Referring additionally now to FIGS. 13A & B, another example of a well tool 76 that can utilize the principles of this disclosure is representatively illustrated. In this example, the well tool 76 comprises a valve for selectively permitting and preventing fluid communication between an interior and an exterior of the valve. However, in other examples, the valve could control fluid communication in other manners (such as, a ball valve the controls flow longitudinally through a tubular string, etc.), and other types of well tools (such as, reamers, jetting tools, etc.) may incorporate the principles of this disclosure.

In the FIGS. 13A & B valve, the indexing device 30 is used to control displacement of the operator device 36, which is connected to a closure device 78. In FIG. 13A, the operator device 36 and closure device 78 are positioned so that fluid communication through ports 80 between the interior and exterior of the valve is prevented.

Figure 13B:
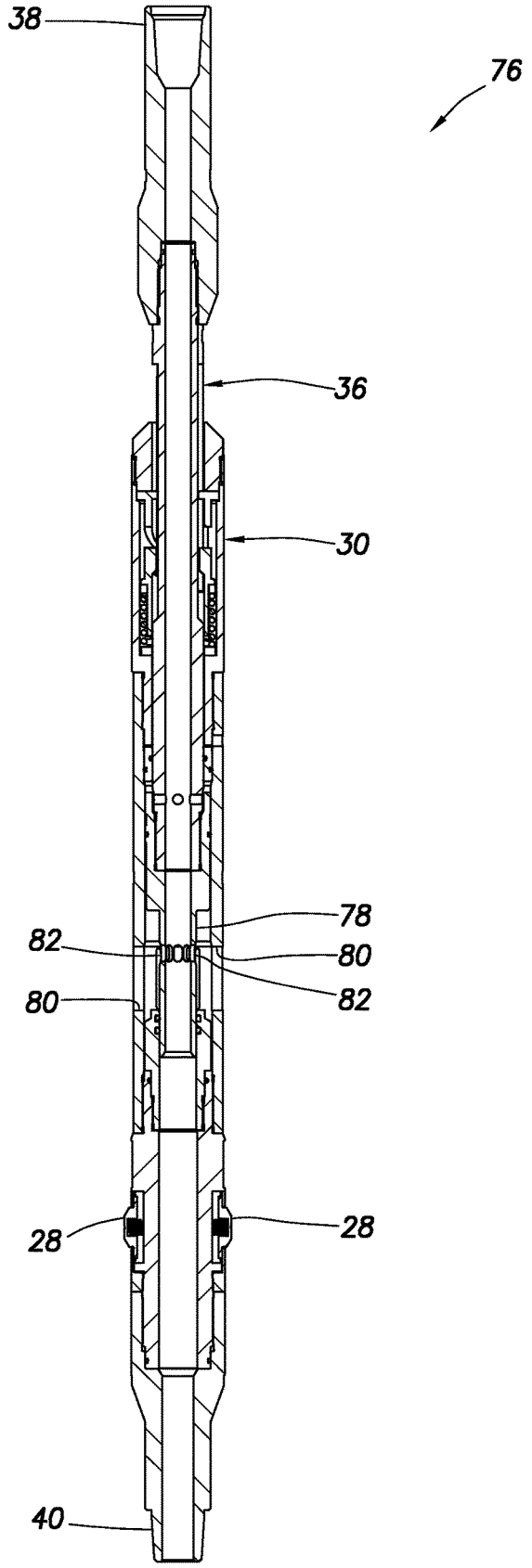

The operator device 36 can be displaced upward relative to the indexing device 30 (e.g., by picking up on a tubular string connected to the connector 38) to thereby align openings 82 in the closure device 78 with the ports 80 as depicted in FIG. 13B. Fluid communication between the interior and exterior of the valve is now permitted.

Subsequent downward displacement of the operator device 36 and closure device 78 relative to the ports 80 is limited by the indexing device 30, thereby permitting the well tool 76 to be displaced downwardly through casing or an uncased wellbore, with the openings 82 remaining aligned with the ports 80 (e.g., to allow the tubular string to fill with fluid as the tubular string is installed in a well). The valve can be closed when desired by again raising the operator device 36 relative to the indexing device 30, and the indexing device will then permit the operator device to displace downward relative to the indexing device a sufficient distance for the closure device 78 to close off fluid communication through the ports 80. Operation of the valve in this manner between its open and closed configurations can be repeated as many times as is required or desired.

It may now be fully appreciated that the above disclosure provides significant advancements to the art of operating well tools downhole. Examples of the indexing and operator devices 30, 36 described above provide for positive indexing between configurations of the well tools 20, 76. The indexing operation is not sensitive to vibration or sticking, and does not rely on a member remaining in one position (e.g., by virtue of friction or inertia) while another member displaces relative to the first member. As a result, the indexing operation is reliably repeatable.

More specifically, the above disclosure provides to the art a well tool 20, 76. In one example described above, the well tool 20, 76 comprises an operator device 36 including an operator profile 58 and at least two routes 56, and an indexing device 30 including a cam 46 and a cam follower 48, the cam follower 48 including a structure 72*a,b* displaceable along each of the routes 56. The structure 72*a,b* engages the routes 56 in succession in response to relative displacement between the operator profile 58 and the cam 46.

The operator profile 58 can be positioned between the routes 56. The structure 72*a,b* may displace partially between the routes 56 in response to engagement between the cam follower 48 and the operator profile 58. The structure 72*a,b* may displace partially between the routes 56 in response to engagement between the cam follower 48 and the cam 46.

The indexing device 30 can include a biasing device 50 that biases the cam follower 48 and cam 46 toward engagement with each other. Relative rotation between the cam 46 and the cam follower 48 may be produced in response to the biased engagement between the cam 46 and the cam follower 48. The operator device 36 may prevent displacement of the structure 72*a,b* toward one of the routes 56, while the operator device 36 displaces relative to the cam follower 48 and the biasing device 50 biases the cam follower toward the route.

The cam 46 may prevent displacement of the structure 72*a,b* toward one of the routes 56, while the operator profile 58 engages the cam follower 48 and the cam follower displaces with the operator device 36.

The routes 56 can have unequal lengths with respect to the structure 72*b*.

The well tool 20 may comprise a packer assembly. The packer assembly can set in response to displacement of the structure 72*a* along one of the routes 56.

The well tool 76 may comprise a valve. The valve can change between open and closed configurations in response to displacement of the structure 72*a* along one of the routes 56.

A method of operating a well tool 20, 76 is also provided to the art by the above disclosure. In one example, the method comprises: causing relative displacement between an operator device 36 and an indexing device 30 in a first direction, thereby causing a structure 72*a,b* of a cam follower 48 of the indexing device 30 to: a) disengage from a first one of at least two routes 56 of the operator device 36, and b) displace an initial portion of a distance between the first route 56 and a second one of the routes 56 in response to engagement between the cam follower 48 and a cam 46 of the indexing device 30; and causing relative displacement between the operator device 36 and the indexing device 30 in a second direction opposite to the first direction, thereby causing the structure 72*a,b* to: a) displace a remaining portion of the distance between the first and second routes 56 in response to engagement between the cam follower 48 and an operator profile 58 of the operator device 36, and b) displace along the second route 56.

The cam follower 48 may displace with the operator device 36 between the steps of displacing the initial portion of the distance and displacing the remaining portion of the distance.

The structure 72*a,b* may displace the initial portion of the distance further in response to a biasing device 50 causing biased engagement between the cam 46 and the cam follower 48.

The structure 72*a,b* may displace the remaining portion of the distance further in response to a biasing device 50 causing biased engagement between the operator profile 58 and the cam follower 48.

The well tool 20 may comprise a packer assembly, and the packer assembly may set in response to the structure 72*a* displacing along the second route 56.

The well tool 76 may comprise a valve, and the valve may change between open and closed positions in response to the structure 72*a* displacing along the second route 56.

A well system 10 is also described above. In one example, the well system 10 can include a well tool 20, 76 positioned in a wellbore 12. The well tool 20, 76 can comprise an operator device 36 including an operator profile 58 between at least two routes 56, and an indexing device 30 including a cam 46 and a cam follower 48, the cam follower including a structure 72*a,b* displaceable along each of the routes 56. The structure 72*a,b* displaces with the operator device 36 while the cam follower 48 is engaged with the cam 46 and the operator profile 58, and while the structure 72*a,b* is disengaged from each of the routes 56.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa.

Accordingly, the foregoing detailed description is to be clearly understood as being given by way of illustration and example only, the spirit and scope of the invention being limited solely by the appended claims and their equivalents.

What is claimed is:

1. A well tool, comprising:

an operator device including an operator profile and at least two routes;

an indexing device including a cam and a cam follower, wherein the cam displaces longitudinally relative to the operator device, wherein the cam follower includes a structure displaceable along each of the routes, wherein the cam follower contacts and displaces along a cam profile formed on the cam, and wherein relative rotation between the operator device and the cam is prevented during all displacements of the cam follower relative to the cam; and wherein the structure engages the routes in succession in response to relative displacement between the operator profile and the cam.

2. The well tool of claim 1, wherein the operator profile is positioned between the routes.

3. The well tool of claim 1, wherein the structure displaces partially between the routes in response to engagement between the cam follower and the operator profile.

4. The well tool of claim 1, wherein the structure displaces partially between the routes in response to engagement between the cam follower and the cam.

5. The well tool of claim 1, wherein the indexing device further includes a biasing device that biases the cam follower and cam toward engagement with each other.

6. The well tool of claim 5, wherein relative rotation between the cam and the cam follower is produced in response to the biased engagement between the cam and the cam follower.

7. The well tool of claim 5, wherein the operator device prevents displacement of the structure toward one of the routes, while the operator device displaces relative to the cam follower and the biasing device biases the cam follower toward the one of the routes.

8. The well tool of claim 1, wherein the cam prevents displacement of the structure toward one of the routes, while the operator profile engages the cam follower and the cam follower displaces with the operator device.

9. The well tool of claim 1, wherein the routes have unequal lengths with respect to the structure.

10. The well tool of claim 1, wherein the well tool comprises a packer assembly, and wherein the packer assembly sets in response to displacement of the structure along one of the routes.

11. The well tool of claim 1, wherein the well tool comprises a valve, and wherein the valve changes between open and closed configurations in response to displacement of the structure along one of the routes.

12. A method of operating a well tool, the method comprising:

causing relative displacement between an operator device and an indexing device in a first direction, thereby causing a structure of a cam follower of the indexing device to: a) disengage from a first one of at least two routes of the operator device, and b) displace an initial portion of a distance between the first route and a second one of the routes in response to engagement between the cam follower and a cam of the indexing device, wherein the cam displaces longitudinally relative to the operator device, and wherein relative rotation between the operator device and the cam is prevented during all displacements of the cam follower relative to the cam; and causing relative displacement between the operator device and the indexing device in a second direction opposite to the first direction, thereby causing the structure to: a) displace a remaining portion of the distance between the first and second routes in response to engagement between the cam follower and an operator profile of the operator device, and b) displace along the second route.

13. The method of claim 12, wherein the cam follower displaces with the operator device between displacing the initial portion of the distance and displacing the remaining portion of the distance.

14. The method of claim 12, wherein the structure displaces the initial portion of the distance further in response to a biasing device causing biased engagement between the cam and the cam follower.

15. The method of claim 12, wherein the structure displaces the remaining portion of the distance further in response to a biasing device causing biased engagement between the operator profile and the cam follower.

16. The method of claim 12, wherein the routes have unequal lengths with respect to the structure.

17. The method of claim 12, wherein the well tool comprises a packer assembly, and wherein the packer assembly sets in response to the structure displacing along the second route.

18. The method of claim 12, wherein the well tool comprises a valve, and wherein the valve changes between open and closed positions in response to the structure displacing along the second route.

19. A well system, comprising:

a well tool positioned in a wellbore, the well tool comprising an operator device including an operator profile between at least two routes, and an indexing device including a cam and a cam follower, wherein the cam displaces longitudinally relative to the operator device, wherein the cam follower includes a structure displaceable along each of the routes, wherein the cam follower contacts and displaces along a cam profile formed on the cam, and wherein relative rotation between the operator device and the cam is prevented during all displacements of the cam follower relative to the cam; and wherein the structure displaces with the operator device while the structure is engaged with the cam and the operator profile, and while the structure is disengaged from each of the routes.

20. The well system of claim 19, wherein the structure engages the routes in succession in response to relative displacement between the operator profile and the cam.

21. The well system of claim 19, wherein the structure displaces partially between the routes in response to engagement between the cam follower and the operator profile.

22. The well system of claim 19, wherein the structure displaces partially between the routes in response to engagement between the cam follower and the cam.

23. The well system of claim 19, wherein the indexing device further includes a biasing device that biases the cam follower and cam toward engagement with each other.

24. The well system of claim 23, wherein relative rotation between the cam and the cam follower is produced in response to the biased engagement between the cam and the cam follower.

25. The well system of claim 23, wherein the operator device prevents displacement of the structure toward one of the routes, while the operator device displaces relative to the cam follower and the biasing device biases the cam follower toward the one of the routes.

26. The well system of claim 19, wherein the cam prevents displacement of the structure toward one of the routes, while the operator profile engages the cam follower and the cam follower displaces with the operator device.

27. The well system of claim 19, wherein the routes have unequal lengths with respect to the structure.

28. The well system of claim 19, wherein the well tool comprises a packer assembly, and wherein the packer assembly sets in response to displacement of the structure along one of the routes.

29. The well system of claim 19, wherein the well tool comprises a valve, and wherein the valve changes between open and closed configurations in response to displacement of the structure along one of the routes.

* * * * *